US008555767B2

(12) United States Patent
Ahn et al.

(10) Patent No.: US 8,555,767 B2
(45) Date of Patent: Oct. 15, 2013

(54) APPARATUS FOR COLLECTING AN EMPTY CARTRIDGE AND CANNON HAVING THE SAME

(75) Inventors: Sang-Tae Ahn, Daejeon (KR); Kuk-Jeong Kang, Daejeon (KR); Suk-Kyun Hong, Daejeon (KR); Chul-Mo Yeo, Gyeongsangnam-Do (KR)

(73) Assignee: Agency for Defense Development (KR)

( * ) Notice: Subject to any disclaimer, the term of this patent is extended or adjusted under 35 U.S.C. 154(b) by 28 days.

(21) Appl. No.: 13/337,622

(22) Filed: Dec. 27, 2011

(65) Prior Publication Data

US 2013/0160637 A1 Jun. 27, 2013

(51) Int. Cl.
*F41A 9/60* (2006.01)

(52) U.S. Cl.
USPC ..... 89/33.4

(58) Field of Classification Search
USPC ..... 89/33.4; 42/98
See application file for complete search history.

(56) References Cited

U.S. PATENT DOCUMENTS 2,865,254 A 12/1958 Aldrin
3,238,844 A 3/1966 Carlsson
5,651,208 A 7/1997 Benson
2003/0221355 A1* 12/2003 Castaldo ..... 42/98
2006/0101699 A1* 5/2006 Perez et al. ..... 42/98

FOREIGN PATENT DOCUMENTS

WO WO 2008/140514 11/2008

OTHER PUBLICATIONS

Search Report issued by European Patent Office on May 31, 2012 in connection with corresponding European patent application No. EP 11 19 5779.

* cited by examiner

*Primary Examiner* — Bret Hayes
(74) *Attorney, Agent, or Firm* — Ostrolenk Faber LLP

(57) ABSTRACT

An apparatus for collecting empty cannon cartridges a bracket spacedly disposed from one or more surfaces of a breech ring for accommodating a cannon barrel therein; an operation pin mounted to the breech ring adjacent to the bracket; an upper link rotatably mounted to one surface of the bracket, and configured to slidingy contact the operation pin; a lower link concentric with the upper link, rotatably mounted to one surface of the bracket, and rotating together with the upper link by being engaged with the upper link at a specific angle; and a collecting unit having one end connected to the lower link, and configured to be unfolded such that empty cartridges extracted from the cannon barrel are collected. When the cannon barrel moves forward, the lower link rotates by being engaged with the upper link as the operation pin slides on the upper link, and the collecting unit is unfolded such that the empty cartridges are collected.

20 Claims, 6 Drawing Sheets

APPARATUS FOR COLLECTING AN EMPTY CARTRIDGE AND CANNON HAVING THE SAME

BACKGROUND OF THE INVENTION

1. Field of the Invention

The present invention relates to an apparatus for collecting an empty cartridge extracted from a cartridge chamber after firing, and a cannon having the same.

2. Background of the Invention

Once a cannon fires ammunition, empty cartridges are discharged through an empty cartridge outlet. Here, the empty cartridges are rapidly discharged to any direction within a predetermined range.

If the empty cartridges are discharged from a cannon having no empty cartridge collector, the discharged empty cartridges may directly harm a user near the empty cartridge outlet. Furthermore, it takes additional time and efforts to collect the discharged empty cartridges. This may cause the loss of fighting strength.

Accordingly, it is an object of the invention to provide an apparatus for collecting empty cartridges at a desired position through a simple structure, and capable of automatically operating without user's manipulations or an additional driving source, and a cannon having the same.

SUMMARY OF THE INVENTION

Therefore, an aspect of the detailed description is to provide an apparatus for collecting an empty cartridge capable of automatically collecting an empty cartridge extracted from a cartridge chamber after firing, at a specific position, and a cannon having the same.

To achieve these and other advantages and in accordance with the purpose of this specification, as embodied and broadly described herein, there is provided an apparatus for collecting an empty cartridge, the apparatus comprising: a bracket disposed to be spacing from one or more surfaces of a breech ring for accommodating a cannon barrel therein; an operation pin mounted to the breech ring adjacent to the bracket; an upper link rotatably mounted to one surface of the bracket, and configured to sliding-contact the operation pin; a lower link concentric with the upper link, rotatably mounted to one surface of the bracket, and rotating together with the upper link by being engaged with the upper link at a specific angle; and a collecting unit having one end connected to the lower link, and configured to be unfolded such that an empty cartridge extracted from the cannon barrel is collected after a bump, wherein when the cannon barrel forward moves, the lower link rotates by being engaged with the upper link as the operation pin slides on the upper link, and the collecting unit is unfolded such that the empty cartridge is collected after firing of the cannon.

The operation pin may slide on one surface of the bracket as the cannon barrel moves backward and forward.

According to another embodiment of the present invention, a first locking protrusion may be protruding from the upper link, and a second locking protrusion locked by the first locking protrusion may be formed at the lower link such that the lower link rotates together with the upper link by being engaged with the upper link at a specific angle.

According to another embodiment of the present invention, the upper link may include a guide unit to which the operation pin sliding-contacts when the cannon barrel moves backward and forward.

According to another embodiment of the present invention, the guide unit may include a first guide surface to which the operation pin sliding-contacts when the cannon barrel moves backward, and a second guide surface adjacent to the first guide surface and to which the operation pin sliding-contacts when the cannon barrel forward moves.

According to another embodiment of the present invention, the apparatus for collecting an empty cartridge may further comprise an upper link return spring configured to provide an elastic force such that the upper link returns to a specific position after the operation pin has completely passed the first or second guide surface.

According to another embodiment of the present invention, the apparatus for collecting an empty cartridge may further comprise a lower link return spring configured to provide an elastic force such that the lower link returns to a specific position after the operation pin has completely passed the second guide surface.

According to another embodiment of the present invention, the second guide surface may have a sliding section of a predetermined length such that the operation pin is slidable until an empty cartridge is completely collected.

According to another embodiment of the present invention, a stopper configured to restrict separation of the operation pin may be protruding from one surface of the lower link adjacent to the upper link.

According to another embodiment of the present invention, another end of the collecting unit may be connected to the bracket, or a link connected to the bracket.

To achieve these and other advantages and in accordance with the purpose of this specification, as embodied and broadly described herein, there is also provided a cannon comprising: a cannon barrel configured to fire ammunition; a breech block configured to open and close a cartridge chamber of the cannon barrel for loading of the ammunition; a breech ring configured to accommodate the breech block therein; a cannon holder configured to mount the cannon barrel thereat, and inclined with respect to the ground such that the breech barrel is toward a specific firing direction; and an apparatus for collecting an empty cartridge disposed to be spacing from one surface of the breech ring, and having a structure in which when the cannon barrel forward moves, a lower link rotates by being engaged with an upper link as an operation pin slides on the upper link, and an extracted empty cartridge is collected by colliding with a collecting unit.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, an apparatus for collecting an empty cartridge and a cannon having the same according to the present invention will be explained in more detail with reference to the attached drawings. A singular expression of this specification includes a plural concept unless there is a contextually distinctive difference therebetween.

Figure 1:
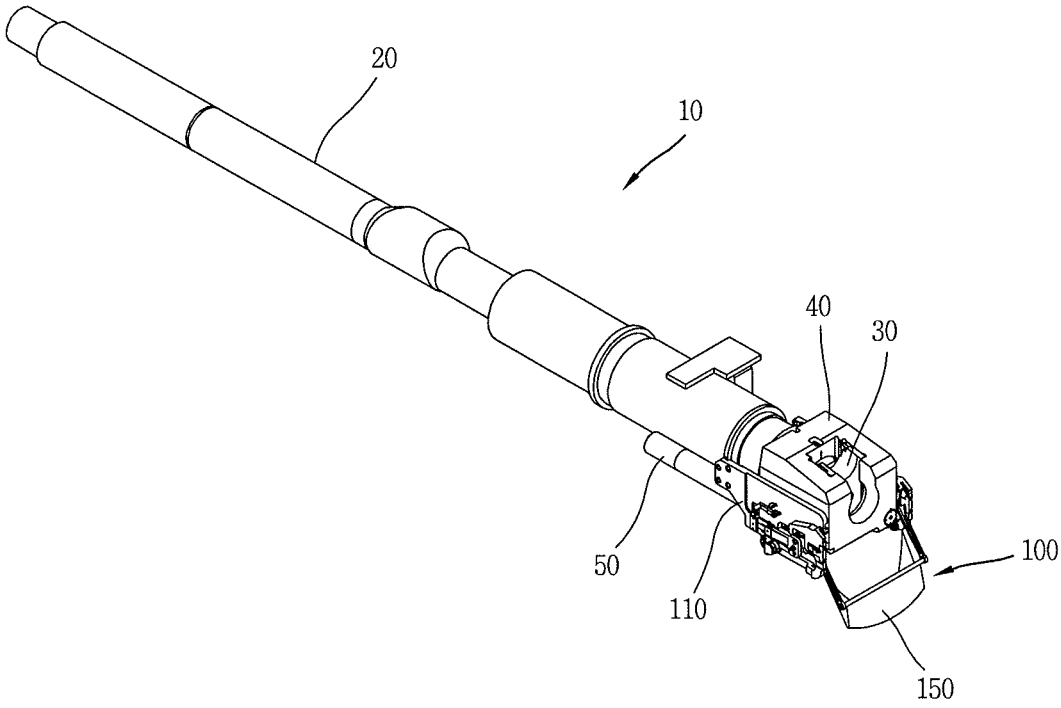
FIG. 1 is a perspective view illustrating a cannon according to one embodiment of the present invention.

FIG. 1 is a perspective view illustrating a cannon 10 according to one embodiment of the present invention.

Referring to FIG. 1, the cannon 10 comprises a cannon barrel 20, a breech device, a cannon holder 50, and an apparatus for collecting an empty cartridge 100. The cannon 10 may be implemented as a tank gun or a machine gun.

The cannon barrel 20 is formed in a shape extending to one direction such that ammunition is fired along a specific direction. The cannon barrel 20 is provided with a rifle therein.

The breech device consists of a breech block 30 and a breech ring 40 for accommodating the breech block 30 therein. The breech block 30 is configured to open and close a rear side of a cartridge chamber of the cannon barrel 20 for loading of ammunition. The breech ring 40 is configured to accommodate therein a rear end of the cannon barrel 20 and the breech block 30, and to backward and forward move in a restricted state with respect to the cannon barrel 20.

The cannon barrel 20 for firing ammunition is mounted to the cannon holder 50. The cannon holder 50 may be inclined with respect to the ground such that the mounted cannon barrel 20 is toward a preset firing direction.

The apparatus for collecting an empty cartridge 100 is disposed near the breach ring 40, and is configured such that extracted ammunition is collected at a desired position, the ammunition extracted through a mechanism by an operation pin 120, an upper link 130 and a lower link 140 as the cannon barrel 20 moves forward and backward.

Hereinafter, will be explained in more details a structure of the apparatus for collecting an empty cartridge 100, and a mechanism for collecting an empty cartridge after firing by the apparatus 100.

Figure 2:
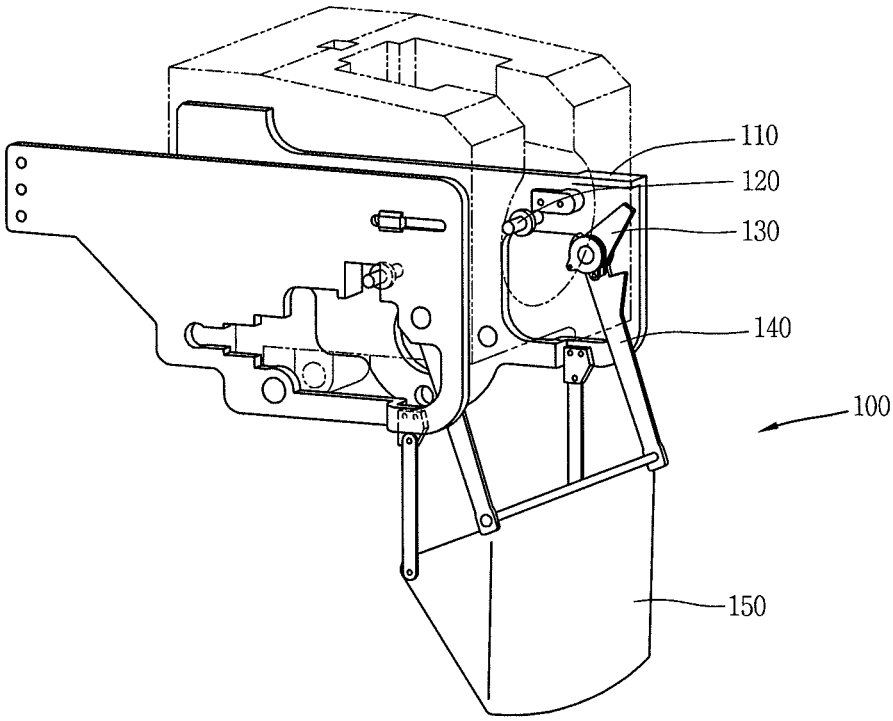
FIG. 2 is a perspective view illustrating an apparatus for collecting an empty cartridge according to one embodiment of the present invention.
Figure 3:
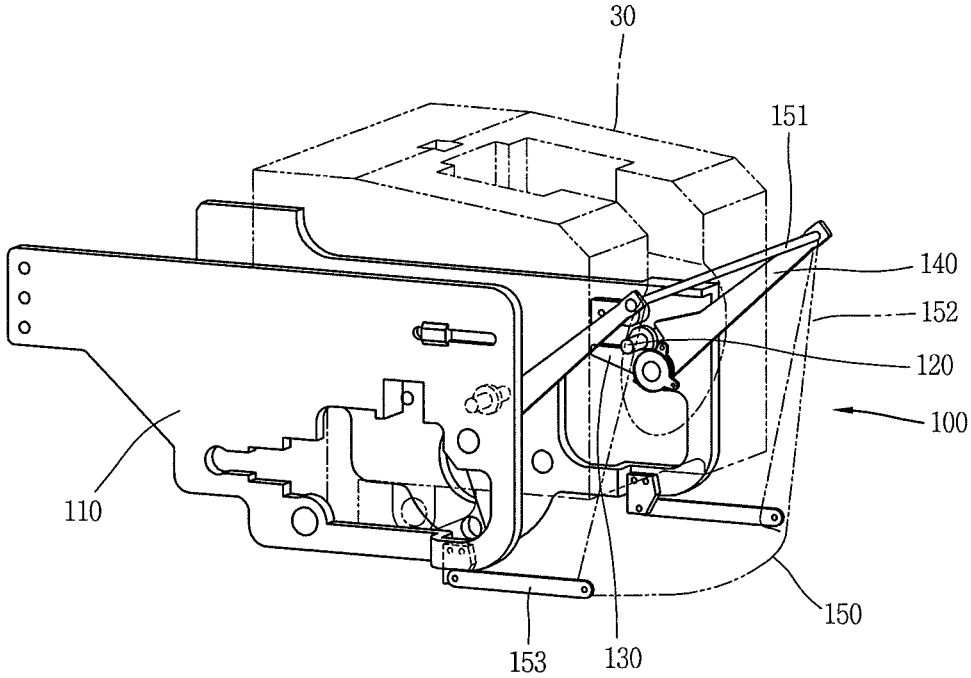
FIG. 3 is a perspective view illustrating an unfolded state of a collecting unit of the apparatus for collecting an empty cartridge of FIG. 2.

FIG. 2 is a perspective view illustrating an apparatus for collecting an empty cartridge according to one embodiment of the present invention, and FIG. 3 is a perspective view illustrating an unfolded state of a collecting unit of the apparatus for collecting an empty cartridge of FIG. 2.

Referring to FIGS. 2 and 3, the apparatus for collecting an empty cartridge 100 comprises a bracket 110, an operation pin 120, an upper link 130, a lower link 140 and a collecting unit 150.

The bracket 110 is configured to support the apparatus for collecting an empty cartridge 100, and each component such as the upper link 130 and the lower link 140 is coupled to the bracket 110. The bracket 110 may be disposed to be adjacent to both side surfaces of the breech ring 40. One end of the bracket 110 may be fixed to the cannon holder 50, and may be configured such that the breech ring 40 performs a relative motion with respect to the apparatus 100 including the bracket 110 when the cannon barrel 20 moves backward and forward according to a firing state.

The operation pin 120 may be formed to extend to one direction, and may be mounted to both side surfaces of the breech ring 40. The operation pin 120 fixed to the breech ring 40 may slide on one surface of the bracket 110 as the cannon barrel 20 moves backward and forward. At the bracket 110, may be formed a through hole extending to one direction in correspondence to a sliding path of the operation pin 120. The operation pin 120 may slide by penetrating the through hole.

The upper link 130 is rotatably mounted to one surface of the bracket 110. For instance, the upper link 130 may be mounted to one surface or another surface of the bracket 110 facing the breech ring 40. The operation pin 120 slides with contacting the upper link 130. The upper link 130 includes a guide unit (first and second guide surfaces 131 and 132) to which the operation pin 120 sliding-contacts when the cannon barrel 20 moves backward and forward (refer to FIG. 4).

The lower link 140 is concentric with the upper link 130, and is rotatably mounted to one surface of the bracket 110 facing the breech ring 40. At the lower link 140, may be formed a second locking protrusion 143 locked by a first locking protrusion 133 of the upper link 130 such that the lower link 140 rotates together with the upper link 130 by being engaged with the upper link 130 at a specific angle (refer to FIG. 4).

The lower link 140 is formed to extend to one direction, and the two lower links 140 are connected to each other by a connecting plate 151. One end of a collecting cover 152 may be connected to the connecting plate 151.

The collecting unit 150 is configured to be unfolded such that an empty cartridge extracted through the breech block 30 is collected at a specific point after firing of the cannon. The collecting unit 150 includes the collecting cover 152 which is in a folded state before firing but an unfolded state after firing. One end of the collecting cover 152 may be connected to the connecting plate 151, and another end thereof may be respectively connected to two brackets 110, or may be connected to a link 153 connected to the bracket 110.

Figure 4:
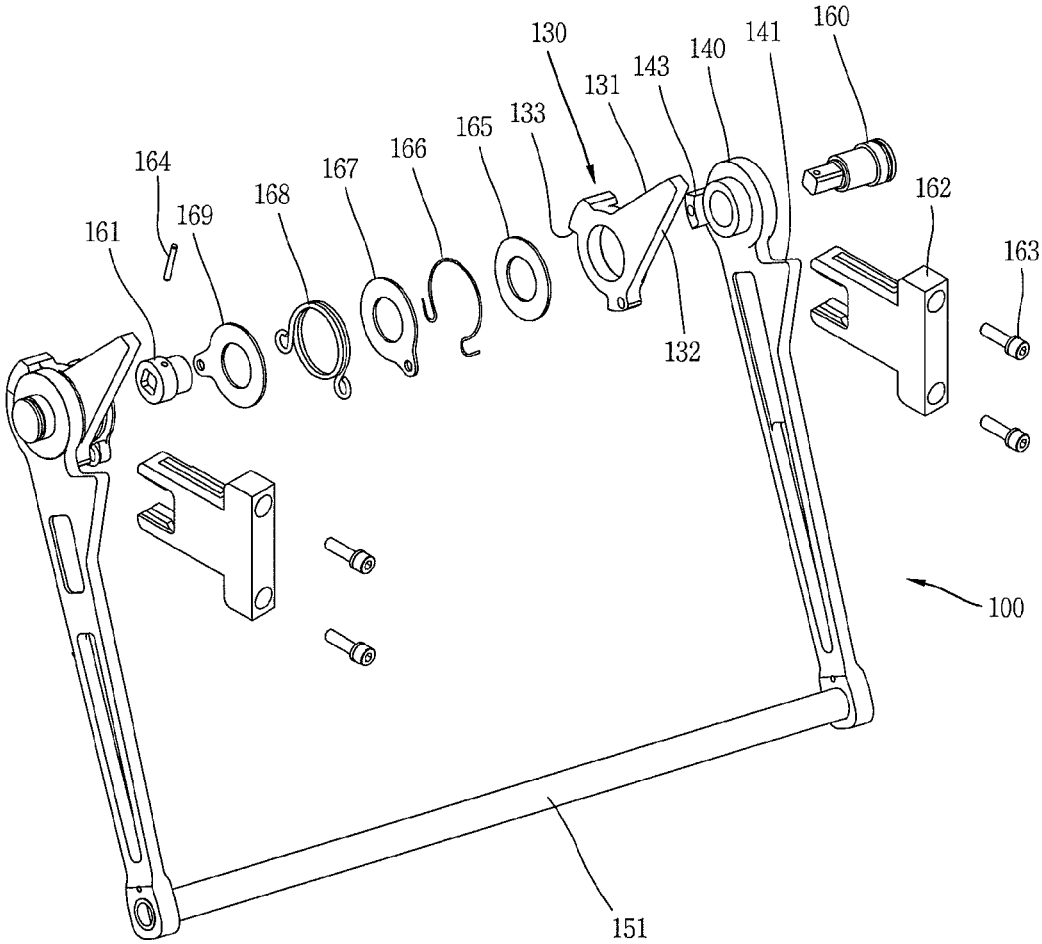
FIG. 4 is a disassembled view of the apparatus for collecting an empty cartridge of FIG. 2.

FIG. 4 is a disassembled view of the apparatus for collecting an empty cartridge 100 of FIG. 2.

Referring to FIG. 4, the operation pin 120 is coupled to the breech ring 40 (not shown). To the bracket 110, sequentially coupled may be a shaft 160, a lower link 140, a first gap maintaining plate 165, an upper link return spring 166, a second gap maintaining plate 167, a lower link return spring 168, a third gap maintaining plate 169 and a coupling pin 161.

The two lower links 140 may be connected to each other by the connecting plate 151, and one end of the collecting cover 152 may be connected to the connecting plate 151.

The shaft 160 connects the upper link 130, the lower link 140, etc. to one another by penetrating through the bracket 110, and is finally coupled to the coupling pin 161. The upper link 130 and the lower link 140 rotate centering around the shaft 160.

The upper link 130 includes a guide unit. The guide unit consists of a first guide surface 131 to which the operation pin 120 sliding-contacts when the cannon barrel 20 moves backward, and a second guide surface 132 adjacent to the first guide surface 131 and to which the operation pin 120 sliding-contacts when the cannon barrel 20 forward moves.

The upper link 130 may be provided with a first locking protrusion 133. For instance, the first locking protrusion 133 may be protruding from the upper link 130 toward the lower link 140. The first locking protrusion 133 is formed to be locked by a second locking protrusion 143 of the lower link 140 at a specific angle.

A stopper 141 configured to restrict separation of the operation pin 120 may be protruding from one surface of the lower link 140. The stopper 141 is configured to prevent separation of the operation pin 120 in a case that a rotation speed of the lower link 140 is faster than a sliding speed of the operation pin 120 when the cannon barrel 20 moves forward.

The upper link return spring 166 provides an elastic force such that the upper link 130 returns to the initial position before firing once the operation pin 120 has completely passed the first or second guide surface 132. The upper link return spring 166 may be connected to the upper link 130 and the lower link 140, respectively.

The lower link return spring 168 provides an elastic force such that the lower link 140 returns to the initial position before firing once the operation pin 120 has completely passed the second guide surface 132. The lower link return spring 168 may be connected to the lower link 140 and the bracket 110, respectively.

Figure 5:
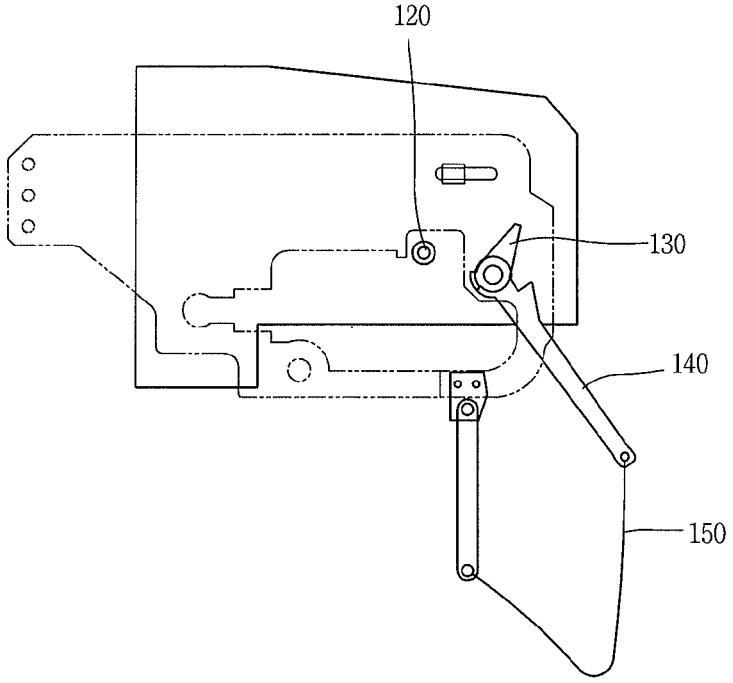
FIGS. 5 to 8 are views illustrating operation states of the apparatus for collecting an empty cartridge of FIG. 2.
Figure 6:
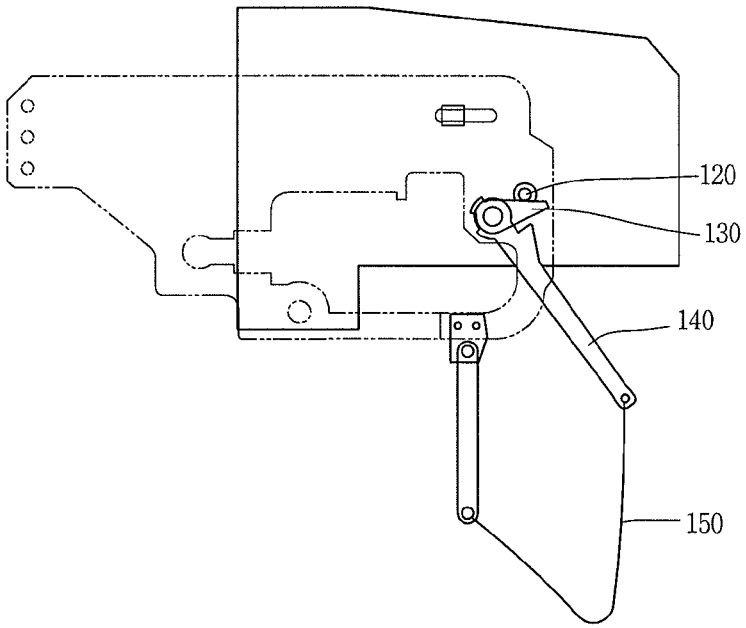
Figure 7:
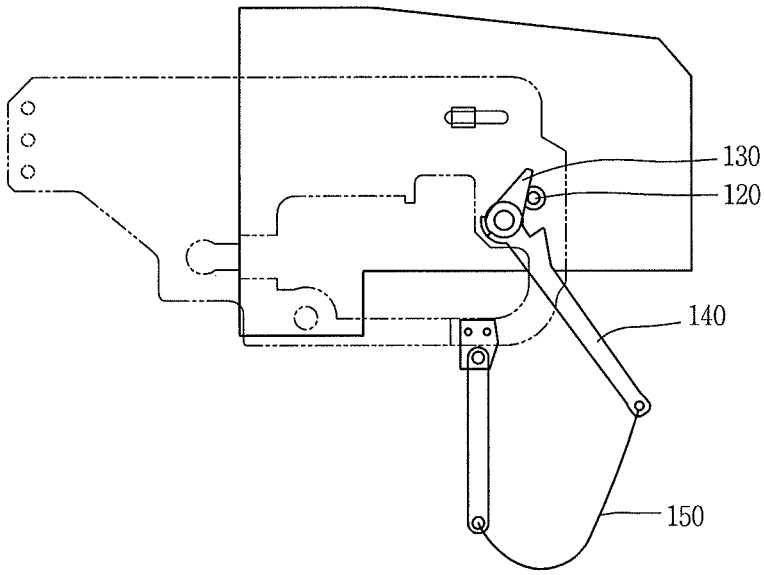
Figure 8:
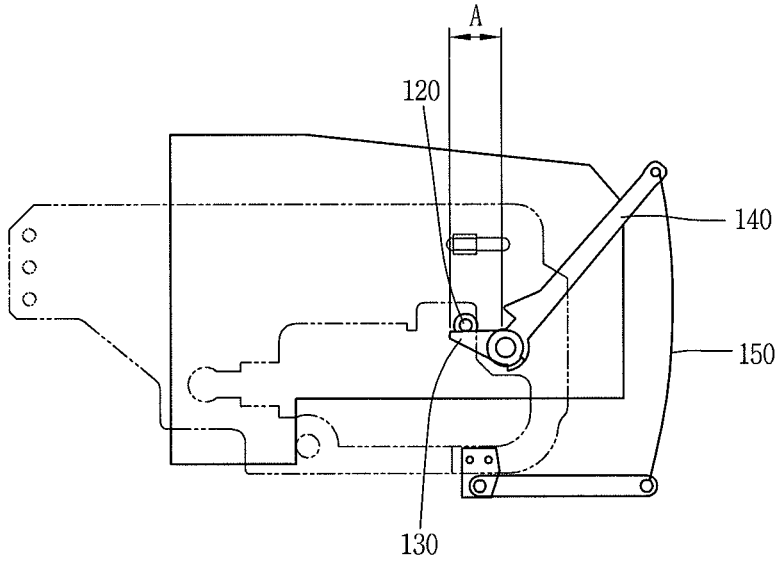

FIGS. 5 to 8 are views illustrating operation states of the apparatus for collecting an empty cartridge 100 of FIG. 2. FIG. 5 illustrates that the cannon barrel 20 is in a stationary state. FIG. 6 illustrates a state that ammunition is fired by a firing command, and the cannon barrel 20 moves backward. FIG. 7 illustrates a state that the cannon barrel 20 forward moves after backward moving. And, FIG. 8 illustrates that an unfolded state of the collecting unit 150 is maintained until an empty cartridge is completely collected.

Referring to FIG. 5, the collecting unit 150 of the apparatus for collecting an empty cartridge 100 is in a folded state (released state) before firing. Since the breech block 30 is open, ammunition can be loaded through the breech block 30.

The operation pin 120 may be disposed so as to be spaced from the upper link 130 and the lower link 140. The guide unit (first and second guide surfaces 131 and 132) of the upper link 130 may be formed so as to be inclined along a sliding direction of the operation pin 120 when the cannon barrel 20 moves backward. The lower link 140 may be disposed toward the ground so as to prevent blocking of the breech block 30 occurring when the collecting unit 150 connected to the lower link 140 is unfolded.

Referring to FIG. 6, the breech block 30 is closed after ammunition is loaded in the cannon, and the cannon barrel 20 moves backward as the ammunition is consecutively fired. As the breech ring 40 moves backward, the operation pin 120 slides toward the upper link 130 along the first guide surface 131 of the upper link 130, thereby rotating the upper link 130. Once the operation pin 120 has completely passed through the upper link 130, the upper link 130 returns to the initial position corresponding to the released state by the upper link return spring 166.

Referring to FIG. 7, as the cannon barrel 20 moves forward, the operation pin 120 slides along the second guide surface 132 of the upper link 130, thereby rotating the upper link 130. During this process, the second locking protrusion 143 is locked by the first locking protrusion 133. Accordingly, the lower link 140 rotates together with the upper link 130. As the lower link 140 rotates, the connecting plate 151 connected to the lower link 140 moves upwardly, and the collecting unit 150 is in an unfolded state, an empty cartridge collecting state. In this state, the breech block 30 is open, and an extracted empty cartridge is collected at a specific position after colliding with the collecting unit 150.

Referring to FIG. 8, the collecting unit 150 has to maintain an unfolded state until an empty cartridge is completely collected. The second guide surface 132 may have a sliding section (A) of a predetermined length such that the operation pin 120 is slidable until an empty cartridge is completely collected. While the operation pin 120 passes through the sliding section (A), an empty cartridge collecting state may be maintained.

Just before completion of the forward moving of the cannon barrel 20, the operation pin 120 is separated from the guide unit (first and second guide surfaces 131 and 132) of the upper link 130, and the upper and lower links 130 and 140 return to the initial position corresponding to the released state by the upper and lower link return springs 166 and 168. Since the collecting unit 150 moves downward toward the ground, the breech block 30 is exposed to the outside, and the cannon is in a loadable state.

In the present invention, as the operation pin slides on the upper link when the cannon barrel forward moves, the lower link rotates together with the upper link by being engaged with the upper link. And, the collecting unit is unfolded such that an empty cartridge is collected after colliding with the collecting unit. This may allow an empty cartridge to be automatically collected at a specific position.

Furthermore, in the present invention, an empty cartridge may be automatically collected without a user's manipulations or an additional driving source since backward and forward movements of the cannon barrel are implemented.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An apparatus for collecting an empty cartridge, the apparatus comprising:

a bracket disposed to be spacing from one or more surfaces of a breech ring for accommodating a cannon barrel therein;

an operation pin mounted to the breech ring adjacent to the bracket;

an upper link rotatably mounted to one surface of the bracket, and configured to slidingy contact the operation pin;

a lower link concentric with the upper link, rotatably mounted to one surface of the bracket, and rotating together with the upper link by being engaged with the upper link at a specific angle; and a collecting unit having one end connected to the lower link, and configured to be unfolded such that an empty cartridge extracted from the cannon barrel is collected in the collecting unit, wherein when the cannon barrel forward moves, the lower link rotates by being engaged with the upper link as the operation pin slides on the upper link, and the collecting unit is unfolded such that the empty cartridge is collected in the collecting unit.

2. The apparatus of claim 1, wherein the operation pin slides on one surface of the bracket as the cannon barrel moves backward and forward.

3. The apparatus of claim 1, wherein a first locking protrusion protrudes from the upper link, and a second locking protrusion locked by the first locking protrusion is formed at the lower link such that the lower link rotates together with the upper link by being engaged with the upper link at a specific angle.

4. The apparatus of claim 1, wherein the upper link comprises a guide unit to which the operation pin sliding-contacts when the cannon barrel moves backward and forward.

5. The apparatus of claim 4, wherein the guide unit comprises:

a first guide surface to which the operation pin sliding-contacts when the cannon barrel moves backward; and a second guide surface adjacent to the first guide surface and to which the operation pin sliding-contacts when the cannon barrel forward moves.

6. The apparatus of claim 5, further comprising an upper link return spring configured to provide an elastic force such that the upper link returns to a specific position after the operation pin has completely passed the first or second guide surface.

7. The apparatus of claim 5, further comprising a lower link return spring configured to provide an elastic force such that the lower link returns to a specific position after the operation pin has completely passed the second guide surface.

8. The apparatus of claim 5, wherein the second guide surface has a sliding section of a predetermined length such that the operation pin is slidable until an empty cartridge is completely collected.

9. The apparatus of claim 1, wherein a stopper configured to restrict separation of the operation pin is protruding from one surface of the lower link adjacent to the upper link.

10. The apparatus of claim 1, wherein another end of the collecting unit is connected to the bracket, or a link connected to the bracket.

11. A cannon, comprising:

a cannon barrel configured to fire ammunition;

a breech block configured to open and close a cartridge chamber of the cannon barrel for loading of the ammunition;

a breech ring configured to accommodate the breech block therein;

a cannon holder configured to mount the cannon barrel thereat, and inclined with respect to a ground surface such that the breech barrel is toward a specific firing direction; and an apparatus for collecting an empty cartridge, the apparatus comprising:

a bracket disposed to be spacing from one or more surfaces of a breech ring for accommodating a cannon barrel therein;

an operation pin mounted to the breech ring adjacent to the bracket;

an upper link rotatably mounted to one surface of the bracket, and configured to slidingy contact the operation pin;

a lower link concentric with the upper link, rotatably mounted to one surface of the bracket, and rotating together with the upper link by being engaged with the upper link at a specific angle; and a collecting unit having one end connected to the lower link, and configured to be unfolded such that an empty cartridge extracted from the cannon barrel is collected in the collecting unit, wherein when the cannon barrel forward moves, the lower link rotates by being engaged with the upper link as the operation pin slides on the upper link, and the collecting unit is unfolded such that the empty cartridge is collected in the collecting unit.

12. The cannon of claim 11, wherein the operation pin slides on one surface of the bracket as the cannon barrel moves backward and forward.

13. The cannon of claim 11, wherein a first locking protrusion is protruding from the upper link, and a second locking protrusion locked by the first locking protrusion is formed at the lower link such that the lower link rotates together with the upper link by being engaged with the upper link at a specific angle.

14. The cannon of claim 11, wherein the upper link comprises a guide unit to which the operation pin sliding-contacts when the cannon barrel moves backward and forward.

15. The cannon of claim 14, wherein the guide unit comprises:

a first guide surface to which the operation pin sliding-contacts when the cannon barrel moves backward; and a second guide surface adjacent to the first guide surface and to which the operation pin sliding-contacts when the cannon barrel forward moves.

16. The cannon of claim 15, further comprising an upper link return spring configured to provide an elastic force such that the upper link returns to a specific position after the operation pin has completely passed the first or second guide surface.

17. The cannon of claim 15, further comprising a lower link return spring configured to provide an elastic force such that the lower link returns to a specific position after the operation pin has completely passed the second guide surface.

18. The cannon of claim 15, wherein the second guide surface has a sliding section of a predetermined length such that the operation pin is slidable until an empty cartridge is completely collected.

19. The cannon of claim 11, wherein a stopper configured to restrict separation of the operation pin is protruding from one surface of the lower link adjacent to the upper link.

20. The cannon of claim 11, wherein another end of the collecting unit is connected to the bracket, or a link connected to the bracket.

* * * * *